US011459688B2

(12) United States Patent
Cha et al.

(10) Patent No.: US 11,459,688 B2
(45) Date of Patent: Oct. 4, 2022

(54) METHOD, APPARATUS AND SYSTEM FOR DETECTING CONTAMINATION OF LAUNDRY TUB USING COMPOSITE SENSOR

(71) Applicant: LG Electronics Inc., Seoul (KR)

(72) Inventors: Seung Chui Cha, Gyeonggi-do (KR); Bon Kwon Koo, Seoul (KR); Hyun Ji Park, Seoul (KR); Sang Hyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 16/582,607

(22) Filed: Sep. 25, 2019

(65) Prior Publication Data

US 2020/0018010 A1 Jan. 16, 2020

(30) Foreign Application Priority Data

Jun. 21, 2019 (KR) ..... 10-2019-0074412

(51) Int. Cl.
*D06F 34/22* (2020.01)
*D06F 39/12* (2006.01)
(Continued)

(52) U.S. Cl.
CPC ..... *D06F 34/22* (2020.02); *D06F 33/43* (2020.02); *D06F 34/14* (2020.02); *D06F 39/12* (2013.01);
(Continued)

(58) Field of Classification Search
CPC ..... D06F 33/43; D06F 33/69; D06F 34/22; D06F 34/24; D06F 35/008;
(Continued)

(56) References Cited

U.S. PATENT DOCUMENTS 5,444,531 A * 8/1995 Foreman ..... A47L 15/4297 68/12.27
2013/0092189 A1* 4/2013 Tang ..... A47L 15/4297 134/18

FOREIGN PATENT DOCUMENTS

EP 862892 A2 * 9/1998 ..... A47L 15/4297
KR 1020160084210 7/2016
KR 1020170098930 8/2017

OTHER PUBLICATIONS

Machine Translation of Feser et al., EP-862892-A2, Sep. 1998. (Year: 1998).*

* cited by examiner

*Primary Examiner* — David G Cormier
(74) *Attorney, Agent, or Firm* — Fish & Richardson P.C.

(57) ABSTRACT

Disclosed is a washing system capable of detecting a level of contamination of a laundry tub by executing a big data, an artificial intelligence (AI) algorithm and/or a machine learning algorithm in a 5G environment connected for things Internet. The washing system capable of detecting a level of contamination of a laundry tub according to one embodiment of the present disclosure includes a composite sensor for detecting a level of contamination of a laundry tub, a washing machine controller that receives a digital signal from the composite sensor to determine a level of contamination of the laundry tub, and a server communicating with the washing machine. The washing machine controller or the server learns AI model with the training data set through a machine learning algorithm in order to predict a progressing degree of contamination of the laundry tub.

5 Claims, 11 Drawing Sheets

(51) Int. Cl.

| | |
|---|---|
| ***D06F 34/14*** | (2020.01) |
| ***D06F 33/43*** | (2020.01) |
| *D06F 21/06* | (2006.01) |
| *D06F 103/16* | (2020.01) |
| *D06F 103/20* | (2020.01) |
| *D06F 103/22* | (2020.01) |
| *D06F 105/02* | (2020.01) |
| *D06F 105/52* | (2020.01) |
| *D06F 105/54* | (2020.01) |
| *D06F 105/58* | (2020.01) |
| *D06F 105/60* | (2020.01) |
| *D06F 34/05* | (2020.01) |
| *D06F 34/10* | (2020.01) |

(52) U.S. Cl.
CPC ..... *D06F 21/06* (2013.01); *D06F 34/05* (2020.02); *D06F 34/10* (2020.02); *D06F 2103/16* (2020.02); *D06F 2103/20* (2020.02); *D06F 2103/22* (2020.02); *D06F 2105/02* (2020.02); *D06F 2105/52* (2020.02); *D06F 2105/54* (2020.02); *D06F 2105/58* (2020.02); *D06F 2105/60* (2020.02)

(58) Field of Classification Search
CPC ..... D06F 2103/16; D06F 2103/20; D06F 2103/22; D06F 2105/54
See application file for complete search history.

METHOD, APPARATUS AND SYSTEM FOR DETECTING CONTAMINATION OF LAUNDRY TUB USING COMPOSITE SENSOR

CROSS-REFERENCE TO RELATED APPLICATION

The present application claims benefit of priority to Korean Patent Application No. 10-2019-0074412, filed on Jun. 21, 2019, the entirety of which is incorporated by reference herein.

BACKGROUND

1. Technical Field

The present disclosure relates to a washing machine including a method, an apparatus and a system for detecting contamination of a laundry tub using a composite sensor, and more particularly to a washing machine or a washing detection system that detects a level of contamination of a laundry tub by utilizing a conductivity sensor, an optical sensor, and a temperature sensor.

2. Description of Related Art

A washing machine in which a laundry tub can freely rotate is generally a washing machine that starts washing by placing laundry and detergent in a laundry tub, and the washing machine is configured of a movable inner tub in which laundry is placed and an outer tub surrounding the inner tub. When a washing machine is used, contaminants remain and accumulate in a laundry tub after washing and dewatering, and the extent to which the inner tub and the outer tub are contaminated differs depending on the number of times the washing machine is used, the amount of detergent used, an environment in which the washing machine is installed, and a user's lifestyle. Conventional washing machines was not provided with a sensor for detecting a level of contamination of the inner and outer tubs of the laundry tub.

In the related art, an example of washing machine discloses a washing machine including a washing machine body having a window section formed on a front panel thereof; an outer tub configured in an interior of the washing machine body, a portion of the outer tub at least corresponding to the window section has a transparent area composed of transparent members; a dewatering tub rotatably configured in an interior of the outer tub; and a tub cleaning unit configured between the outer tub and the dewatering tub, the tub cleaning unit being disposed in a position corresponding to the window section and the transparent area to abut against an outer surface of the dewatering tub. The washing machine was not provided with a contamination detection sensor for notifying the cleaning of the tub, so that the time required for cleaning the tub was visually confirmed. The washing machine of patent literature 1 requires visual inspection by a user and manually operates a tub washing unit when the user determines that the tub cleaning is necessary. Therefore, it was not possible to quantitatively determine how much the laundry was contaminated, and the level of contamination was determined by the judgment by the user. In addition, since a tub washing unit for mechanically cleaning the tub was additionally provided in the laundry tub, the number of components of the washing machine was increased, and separate maintenance was required.

Other example of washing machine discloses a control method for a washing machine, the washing machine including: an outer tub for holding water; and an inner tub that is located within the outer tub, exchanges water with the outer tub, and is rotatable on a vertical axis, the method including: (a) each time that a wash cycle runs after a previous tub cleaning course, storing a cumulative number of times the wash cycle has run since the previous tub cleaning course; (b) selecting the tub cleaning course; (c) configuring settings of the tub cleaning course based on the stored cumulative number of times the wash cycle has been run; and (d) conducting the tub cleaning course according to the configured settings. In the washing machine, when the tub cleaning notification count value read from PROM is equal to or more than a predetermined number of times, it entered into the notification mode of tub cleaning time. Since the washing machine of patent literature 2 was also not provided with a contamination detection sensor for notifying the cleaning of the tub, it was not possible to know a level of contamination of the laundry tub.

FIG. 1 is a flowchart illustrating a system of notifying the tub cleaning of a conventional washing machine. In the conventional washing machine, the tub cleaning notification count operation includes operating all the basic processes of washing, rinsing and dewatering, and at the "end" of the processes, reading the tub cleaning notification count from count EEPROM, increasing it by 1, and then storing again it in the EEPROM. If the setting value of the tub cleaning is equal to or more than a specific number of times, "tcL" which is a tub sterilization notification message is displayed on a display. When a tub sterilization course is operated, a notification count of the tub cleaning time is initialized and stored to 0 at the "end" of the processes. In the conventional washing machine, the notification of the tub cleaning time is executed when an entry condition is satisfied, and released when a release condition is satisfied. The entry condition is that if the notification count value of the tub cleaning read from the EEPROM is, for example, 30 when the power is turned on, entry is made in a notification mode of the tub cleaning time. The release condition is that it is automatically released 5 seconds after entry of the notification mode of the tub cleaning time, or automatically released at the key input in the notification mode of the tub cleaning time (in case of the input processed key).

FIG. 2 is an exemplary view showing a rinse-automatic tub cleaning of a conventional washing machine. The conventional washing machine performed a rinse-automatic cleaning when the tub sterilization course was operated. In the rinse-automatic cleaning course, the first rinsing and dewatering are performed to enhance a first cleaning power, water is supplied for 20 seconds, then drained after water supply at 108 rpm to improve foam overflow. Subsequently, water is supplied at 108 rpm, and a second cleaning power enhancement course is executed with two-stage strong flow of water like water cannon at 150 rpm and 130 rpm. Subsequently, rinsing and water re-supply are performed. When the conventional rinse automatic tub cleaning is performed, since this does not perform the tub cleaning by detecting a level of contamination of a laundry tub, foam overflow often occurred in the first rinsing.

The conventional washing machine was not provided with a sensor for detecting contamination in order to notify the cleaning of the tub as described above. Thus, it was designed to visually check the tub cleaning time, or to display notification of the tub cleaning time when the number of times of use exceeds a predetermined number of times, or to perform an automatic tub cleaning in the first rinsing during the progress of the cleaning. Therefore, foam overflows and power consumption increases during the progress of the automatic tub cleaning.

In addition, conventional conductivity sensor and optical sensor generate noise while transmitting an analog signal to a controller including a washing machine MCU, and the conductivity and transmittance of the analog signal is transmitted to the controller including the washing machine MCU, and then the temperature correction has been performed. Therefore, there was a high possibility of distortion in the temperature-corrected conductivity and transmittance values.

SUMMARY OF THE INVENTION

The present disclosure has been made to solve the problems that occurs when a conventional washing machine is not provided with a sensor for detecting contamination in order to notify the cleaning of the tub.

Specifically, a technical task of the present disclosure is to provide a sensor that detects contamination in order to notify the tub cleaning time, and transmits the detected signal to a washing machine controller including a washing machine MCU without distortion.

Another technical task of the present disclosure is to provide a configuration for detecting contamination of a laundry tub from a contamination detection sensor.

The other technical task of the present disclosure is to determine a level of contamination through a machine learning algorithm based on data regarding a level of contamination of a laundry tub stored in a washing machine and a server.

Technical solutions obtainable from the present disclosure are not limited to the above-mentioned technical solutions. And, other unmentioned technical solutions can be clearly understood from the following description by those having ordinary skill in the technical field to which the present invention pertains.

In order to achieve these and other tasks, a method and a washing system for detecting a level of contamination of a laundry tub according to an embodiment of the present disclosure may be configured of a washing machine including a composite sensor that integrates a conductivity sensor, an optical sensor, a temperature sensor, and a MCU into one module to detect a level of contamination of the laundry tub, and a washing machine controller that receives signals from the composite sensor and controls the laundry tub; or a server communicating with the washing machine.

A method and a washing system for detecting a level of contamination of a laundry tub according to another embodiment of the present disclosure may include: a configuration for measuring an initial value of a composite sensor which is a standard for determining a level of contamination of the laundry tub when water supply, drainage, and dewatering processes are performed without detergent and laundry at the time of installing the washing machine; a configuration for transmitting the initial value of the composite sensor to a washing machine controller through a sensor MCU; a configuration for measuring a final rinse cycle value of the composite sensor when a user performs washing and rinsing processes after installing the washing machine; a configuration of transmitting the measured final rinse cycle value of the composite sensor from the sensor MCU part to the washing machine controller, and a configuration for comparing the initial value of the composite sensor with the final rinse cycle value of the composite sensor at the washing machine controller or at a server receiving the initial value and the final rinse cycle value of the composite sensor from the washing machine controller to thereby determine a level of contamination of the laundry tub. Conventional washing machines were not provided with a sensor for detecting a level of contamination of the laundry tub and thus, has not guided to a user the tub cleaning time depending on the level of contamination. However, the washing machine of the present disclosure can measure an initial value of a composite sensor of the non-contaminated wash water which is a standard for determining the level of contamination of the laundry tub by the composite sensor, and thus, can compare the initial value of the composite sensor and the final rinse cycle value of the composite sensor to determine the level of contamination of the laundry tub.

A composite sensor according to another embodiment of the present disclosure may include a conductivity sensor that detects conductivity to detect conductive contamination, an optical sensor that detects a light transmittance to detect non-conductive contamination, a temperature sensor that detects temperature, and a sensor MCU part that includes a correction algorithm for correcting a conductivity value and a transmittance value according to the temperature measured by the temperature sensor, converts analog signals of the conductivity sensor and the optical sensor into digital signals, and transmits a composite sensor value, which is a temperature-corrected conductivity data and a transmittance data to the washing machine controller by the correction algorithm.

A washing machine for detecting a level of contamination of a laundry tub according to another embodiment of the present disclosure may include a conductivity sensor that detects conductivity to detect conductive contamination in a laundry tub, an optical sensor that detects a light transmittance to detect non-conductive contamination in the laundry tub, a temperature sensor that detects temperature in the laundry tub, a composite sensor that detects a level of contamination level of the laundry tub by integrating the sensor MCU including a correction algorithm that corrects a conductivity value and a transmittance value according to the temperature into one module, and a washing machine controller that receives a digital signal from a composite sensor to determine a level of contamination of the laundry tub.

Advantageous effects of the present disclosure are not limited to the aforementioned effects, and other advantageous effects that are not described herein should be clearly understood by those skilled in the art from the following description.

DETAILED DESCRIPTION

Advantages and features of the present disclosure and methods for achieving them will become apparent from the descriptions of aspects herein below with reference to the accompanying drawings. However, the present disclosure is not limited to the aspects disclosed herein but may be embodied in various different forms, and should be understood to include all modifications, equivalents, and replacements belonging to the concept and the technical scope of the invention. The embodiments set forth herein are provided so that this disclosure will be thorough and complete, and will fully convey the concept of the invention to those skilled in the art. In relation to describing the present disclosure, when the detailed description of the relevant known technology is determined to unnecessarily obscure the gist of the present disclosure, the detailed description may be omitted.

The terminology used herein is for the purpose of describing particular example embodiments only and is not intended to be limiting. As used herein, the singular forms "a," "an," and "the" may be intended to include the plural forms as well, unless the context clearly indicates otherwise. The terms such as "include" and "have" are intended to indicate that features, numbers, steps, operations, elements, components, or combinations thereof used in the following description exist and it should thus be understood that the possibility of existence or addition of one or more other different features, numbers, steps, operations, elements, components, or combinations thereof is not excluded. Although the terms first, second, etc. may be used herein to describe various elements, these elements should not be limited by these terms. These terms may be only used to distinguish one element from another element.

In describing the present invention, names of elements are defined taking functions thereof into account. Therefore, it is required to understand that the names do not limit the elements technically. Moreover, the names of the elements may be called differently in this field of art.

Hereinafter, a washing machine 100 according to an embodiment of the present invention will be described in detail with reference to the attached drawings.

Figure 1:
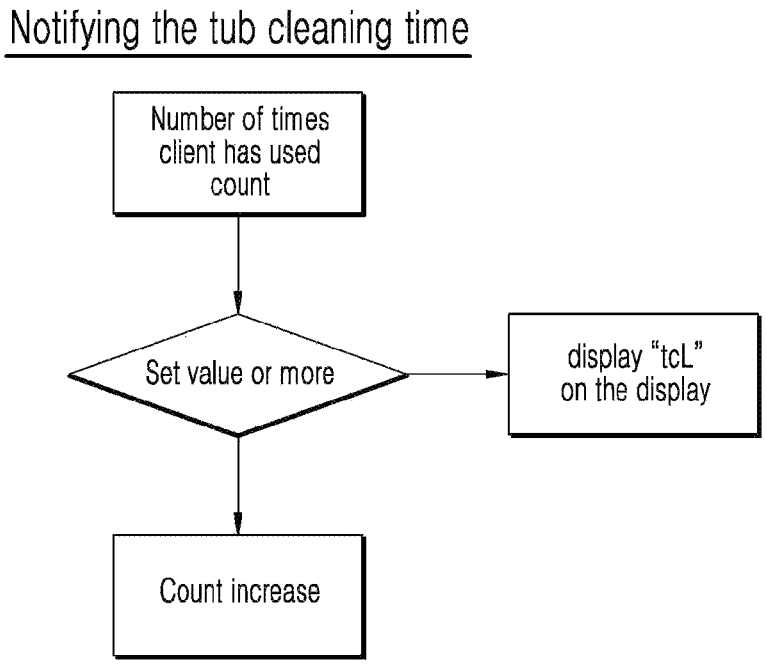
FIG. 1 is a flowchart illustrating a system of notifying the tub cleaning of a conventional washing machine.
Figure 2:
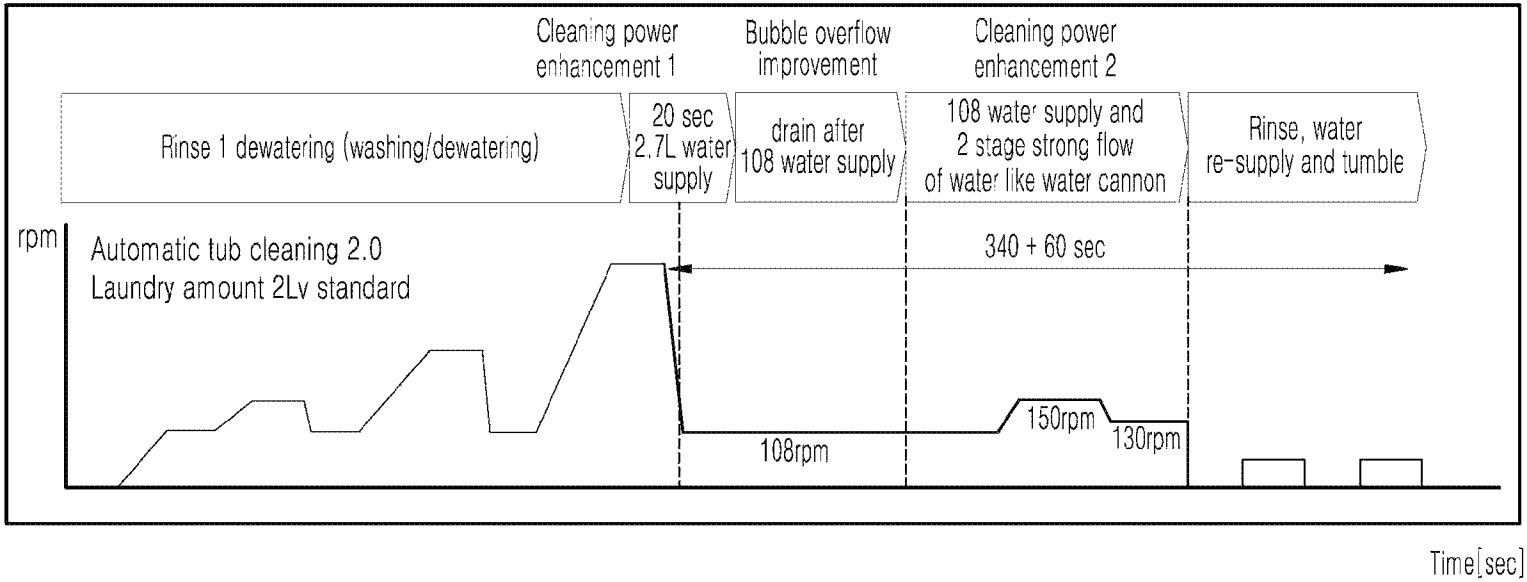
FIG. 2 is an exemplary view showing a rinse-automatic tub cleaning of a conventional washing machine.
Figure 3:
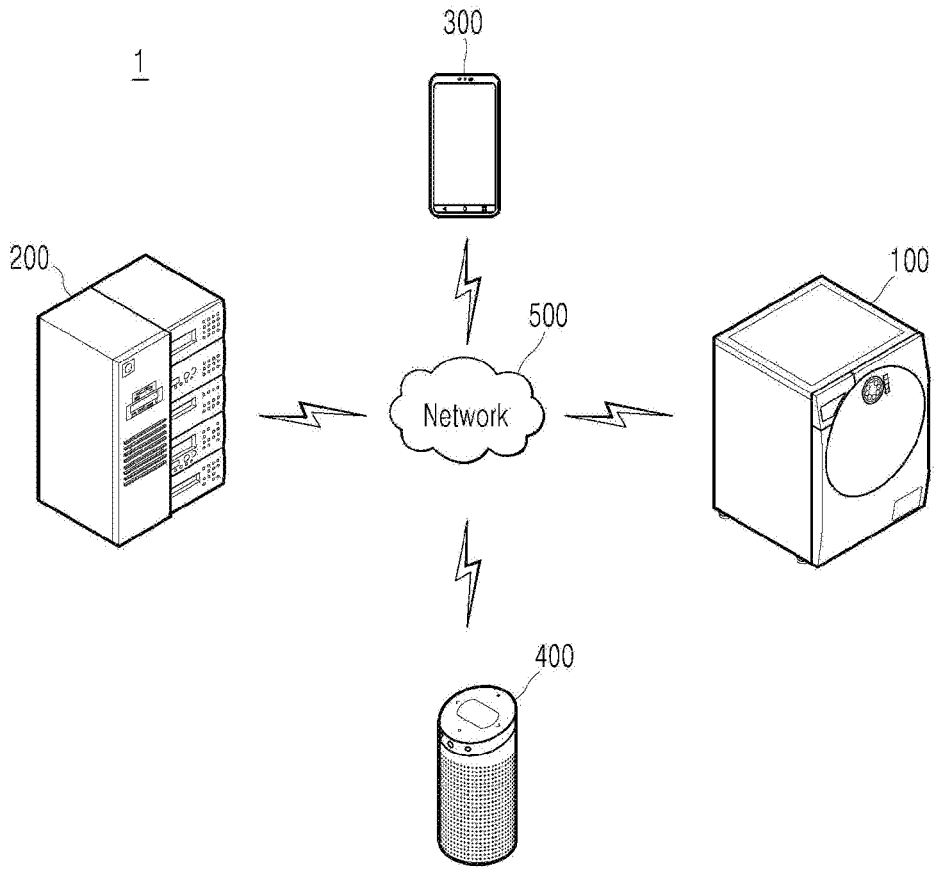
FIG. 3 is an exemplary view showing a driving environment of a washing system including a washing machine, a user terminal, an output device, and a network which connects them to each another, in the washing system according to an embodiment of the present invention.

FIG. 3 is an exemplary diagram of a driving environment 1 including a washing machine 100 according to an embodiment of the present disclosure, an output device capable of transmitting instruction to the washing machine 100, a user terminal, a server, and a network which connects them to each another. The washing machine 100 or washing system capable of detecting a level of contamination of a laundry tub can determine a precise contamination level using a big data, an artificial intelligence (AI) algorithm and/or a machine learning algorithm in a 5G environment connected for things Internet.

Referring to FIG. 3, the driving environment 1 of the washing system may include a washing machine 100, a server 200, a user terminal 300, an output device 400, and a network 500. The output device 400 can include an artificial intelligence speaker, an artificial intelligence TV, and other communication devices. The washing machine 100 may include a communication part and may transmit a composite sensor value regarding the level of contamination of the laundry tub to the server 200 through a wired or wireless network 500. The server 200 can transmit data including information regarding the level of contamination of the laundry tub and various washing information to the washing machine 100, the user terminal 300, and the output device 400 such as an artificial intelligent speaker.

The washing machine 100 may include a communication part, an input part, a sensing part including a composite sensor 130, an output part including a display, a storage part including a memory, a power supply part, a washing part including physical devices required for washing, such as a laundry tub, and a controller including a washing machine MCU.

In an embodiment of the present invention, the washing machine 100 for detecting a level of contamination of a laundry tub includes a composite sensor 130, and a washing machine controller that receives a digital signal from the composite sensor 130 to determine the level of contamination of the laundry tub. The composite sensor 130 can integrate a conductivity sensor 137 that detects conductivity to detect conductive contamination in the laundry tub, an optical sensor 134 that detects a light transmittance to detect non-conductive contamination in the laundry tub, a temperature sensor 136 that detects temperature in the laundry tub, and a sensor MCU part 132 including a correction algorithm that corrects a conductivity value and a transmittance value according to temperature, into one module to thereby detect a level of contamination of the laundry tub.

The sensing part of the washing machine 100 includes sensors that detects elements required to control for washing, and it refers to a composite sensor 130 that detects a level of contamination of a laundry tub unless otherwise specified herein. When installing a washing machine 100 at user's home, in order to check the presence/absence of an operation and the installation state of the washing machine, the composite sensor 130 can transmit an initial value of the composite sensor measured when performing water supply, drainage, dewatering processes without detergent or laundry, and a final rinse cycle value of the composite sensor measured in the final rinsing when a user performs washing and rinsing processes, to a washing machine controller via a sensor MCU part 132, and the washing machine controller can store an initial value of the composite sensor and a final rinse cycle value of the composite sensor in the storage unit and compare the initial value of the composite sensor and a final rinse cycle value of the composite sensor to determine the level of contamination of the laundry tub.

The washing system for detecting the level of contamination of the laundry tub according to one embodiment of the present disclosure may include a washing machine 100 including a composite sensor 130, and a washing machine controller that receives a digital signal from the composite sensor 130 and determines the level of contamination of the laundry tub, and a server for communicating with the washing machine 100. The composite sensor 130 of the washing machine 100 can transmit an initial value of the composite sensor and a final rinse cycle value of the composite sensor to the washing machine controller through a sensor MCU part 132, the washing machine controller wirelessly communicates with the server to transmit the initial value of the composite sensor and the final rinse cycle value of the composite sensor to the server, and the server can receive the initial value of the composite sensor and the final rinse cycle value of the composite sensor from the washing machine controller and compare the initial value of the composite sensor with the final rinse cycle value of the composite sensor to determine the level of contamination of the laundry tub.

The washing machine controller may include any kind of device capable of processing data, like a processor, for example an MCU. Here, a 'processor' may refer to a data processing apparatus embedded in hardware, for example, having a circuit physically structured to perform a function represented by a code or a command contained in the program. As an example of the data processing apparatus embedded in hardware in this manner, a processing apparatus such as a microprocessor, a central processing unit (CPU), a processor core, a multiprocessor, an application-specific integrated circuit (ASIC), and a field programmable gate array (FPGA) can be covered, but the scope of the present disclosure is not limited thereto.

In this embodiment, the washing machine 100 and the server 200 can perform a retrieval of the output device 400, a volume adjustment of the audio signal output from the output device 400, and machine learning such as deep learning for the selection of the output device 400, and the storage unit may store data used for machine learning, result data, and the like.

On the other hand, the washing machine 100 and the server 200 may be equipped with an artificial neural network, retrieve at least one output device 400 that is disposed in the same space as the washing machine 100 and is outputting at least one of an audio signal or a video signal, and perform a retrieval of the machine learning based output device 400 and adjustment of the output signal so that the output signals of one or more output devices 400 retrieved corresponding to the operation mode can be adjusted. In addition, the washing machine 100 may select at least one of the one or more output devices 400 retrieved corresponding to the operation mode, and performs machine learning based output device 400 selection and output signal transmission so that at least one of audio or video signals can be transmitted to the selected output device 400.

The washing machine communication part can provide a communication interface required to provide transmission/reception signals between an output device 400, a user terminal 300, and/or a server 400 in the form of packet data in cooperation with a network 500. Further, the communication part 110 can support various kinds of machine-to-machine communications (IoT (internet of things), IoE (internet of everything), IoST (internet of small things), etc.) and support M2M (machine to machine) communication, V2X (vehicle to everything communication) communication, D2D (device to device) communication, and the like.

In this embodiment, the user terminal 300 may be desktop computer, smart phone, notebook, tablet PC, smart TV, mobile phone, personal digital assistant (PDA), laptop, media player, micro-server, global positioning system (GPS) device, electronic book terminal, digital broadcasting terminal, navigation, kiosk, MP3 player, digital camera, home appliances and other mobile or non-mobile computing devices which are operated by an user, but is not limited thereto. In addition, the user terminal 300 may be a wearable terminal such as a watch, glasses, a hair band, a ring and the like having a communication function and a data processing function. The user terminal 300 is not limited to the content described above, and a terminal capable of web browsing can be used without limitation. In an alternative embodiment, the user terminal 300 may operate with any one of the output devices 400 described above.

The server 200 may be a database server that provides big data required for applying various artificial intelligence algorithms and data for operating the washing machine 100. In addition, the server 200 may include a web server or an application server that enable remote control of the operation of the washing machine 100 using a washing machine-driven application or a washing machine-driven web browser installed in the user terminal 300.

Here, artificial intelligence (AI) is an area of computer engineering and information technology that are researching methods that enable computers to perform thinking, learning, and self-enlightening that can be done by human intelligence, and may refer to allowing computers to mimic human intelligent behavior.

In addition, the artificial intelligence does not exist by itself, but has many links directly or indirectly with other areas of computer science. Especially, nowadays, attempts are being made very actively to introduce elements of artificial intelligence in many fields of information technology and utilize them to solve problems in that field.

Machine learning is an area of artificial intelligence, and may include a field of study that gives computers the ability to learn without being explicitly programmed. Specifically, machine learning may be a system that generates training data sets and/or test data sets based on empirical data to perform learning, determines a learned model, performs predictions, and improves one's own performance, and a technology for studying and constructing an algorithm for that purpose. Machine learning algorithms can take the form of constructing a specific model to derive predictions or decisions based on input data, rather than performing strictly defined static program instructions.

The server 200 can receive retrieval results of at least one output device 400 operating from the washing machine 100 and an operation mode of the washing machine 100, and transmit to the washing machine 100 the output signal adjustment control signal of the one or more output devices 400 retrieved corresponding to an operation mode. In addition, the server 200 can receive from the washing machine 100 the operation mode of the washing machine 100, transmit the result of selecting at least one of the one or more output devices 400 to the washing machine 100, and control so as to transmit at least one of an audio signal or a video signal with the output device 400 selected by the washing machine 100.

The network 500 may perform a role to connect the washing machine 100, the output device 400, the user terminal 300, and the server 200. Such a network 500 may cover wired networks such as LANs (local area networks), WANs (wide area networks), MANs (metropolitan area networks), ISDNs (integrated service digital networks), or wireless networks such as wireless LANs, CDMA, Bluetooth, satellite communication, and the like, but the scope of the present disclosure is not limited thereto. The network 500 may also transmit and receive information using a short-distance communication and/or a long-distance communication. Here, the short-distance communication may include Bluetooth, RFID (radio frequency identification), infrared data association (IrDA), UWB (ultra-wideband), ZigBee, Wi-Fi (wireless fidelity) technologies, and the long-distance communication may include CDMA (code division multiple access), FDMA (frequency division multiple access), TDMA (time division multiple access), OFDMA (orthogonal frequency division multiple access), SC-FDMA (single carrier frequency division multiple access) technologies.

The network 500 may include connections of network elements such as hubs, bridges, routers, switches and gateways. The network 500 may include one or more connected networks, e.g., multiple network environments, including a public network such as the Internet, and a company's private network such as secure enterprise private networks. Access to the network 500 may be provided via one or more wired or wireless access networks. Furthermore, the network 500 may support an Internet of Things (IoT) network and/or 5G communication, which exchanges information between distributed components such as things.

Figure 4:
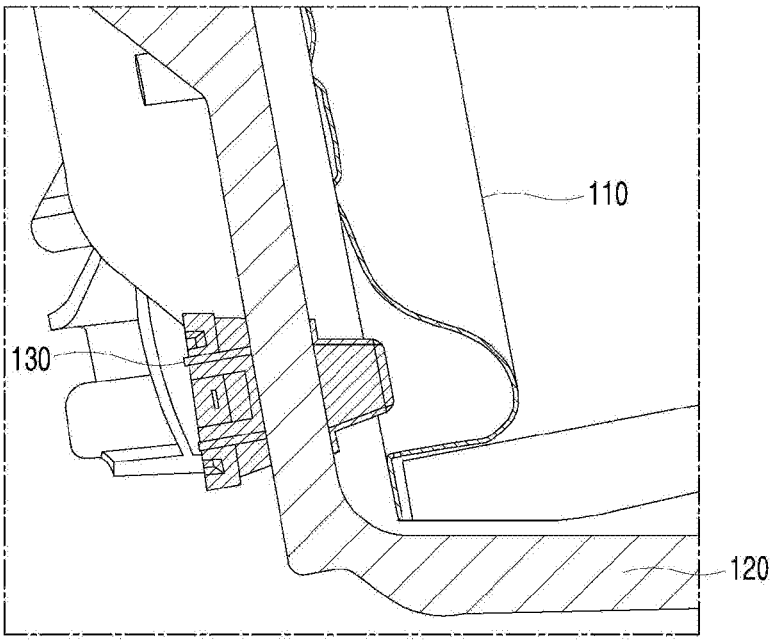
FIG. 4 is an exemplary view in which a composite sensor is installed inside a washing machine according to an embodiment of the present disclosure.

FIG. 4 is an exemplary view in which a composite sensor 130 is installed inside a washing machine according to an embodiment of the present disclosure. The washing machine 100 generally starts washing by placing laundry and detergent in a laundry tub, and the washing machine 100 is configured of a movable inner tub 110 in which laundry is placed and an outer tub 120 surrounding the inner tub. The water supplied to the inner tub 110 of the laundry tub is discharged to the outer tub 120 through a plurality of water through holes formed in the laundry tub. Therefore, when washing is performed, the inner tub 110 and the outer tub 120 of the laundry tub are in a state of being immersed in a wash water and a rinse water. After washing or dewatering using the washing machine 100, contaminants remain and accumulate in the laundry tub. The composite sensor 130 may be mounted at a place where water touches in the laundry tub. In one embodiment, the composite sensor 130 may be located near the bottom of the laundry tub where water stays for longest periods of time and then is drained. The composite sensor 130 may be attached to the laundry tub in a detachable manner. When the composite sensor 130 is attached to the laundry tub in a detachable manner, it can be easily replaced when replacing parts.

Figure 5:
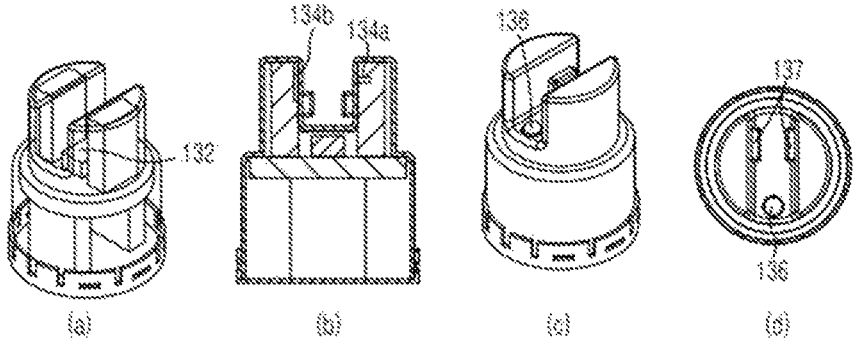
FIG. 5 is an exemplary view of (a) an MCU part, (b) an optical sensor, (c) a temperature sensor, and (d) a conductivity sensor, which are located in a composite sensor according to an embodiment of the present disclosure.

FIG. 5 is an exemplary view of (a) an MCU part 132, (b) an optical sensor 134, (c) a temperature sensor 136, and (d) a conductivity sensor 137, which are located inside a composite sensor 130 of the washing machine 100 according to an embodiment of the present disclosure. The composite sensor 130 may include a conductivity sensor 137 that detects conductivity to detect conductive contamination, an optical sensor 134 that detects a light transmittance to detect non-conductive contamination, a temperature sensor 136 that detects temperature, and a sensor MCU part 132 including a correction algorithm that corrects a conductivity value and a transmittance value according to the temperature measured by the temperature sensor 136. The optical sensor 134 includes an LED 134*a* that emits light and a phototransistor 134*b* that detects light emitted from the LED 134*a*. The sensor MCU part 132 converts analog signals generated from the conductivity sensor 137 and the optical sensor 134 into digital signals, and outputs the temperature-corrected conductivity data and transmittance data by a correction algorithm. Temperature data, temperature-corrected conductivity data and transmittance data may be output from the composite sensor 130, and these data may be the composite sensor values output from the composite sensor 130. The sensor MCU part 132 of the composite sensor 130 may transmit the conductivity data, the transmittance and data temperature data detected by the composite sensor 130 to the washing machine controller. The conductivity sensor is also referred to as an electrode sensor. Since the optical sensor detects a light transmittance, the concept opposite to the light transmittance may be displayed as a turbidity. The higher the light transmittance from a liquid, the lower the turbidity, and conversely, the lower the transmittance, the higher the turbidity.

A conventional electrode sensor that detects conductivity, an optical sensor that detects light transmittance, and an sensor that detects temperature are individually located in the laundry tub, and each of these sensors transmitted analog values to the washing machine controller. The washing machine controller receives these values and processes, i.e., converts, an analog signal into a digital signal and then corrects a conductivity value and a transmittance based on the temperature received from the temperature sensor. When transferring data to the washing machine controller, since the conductivity value, the transmission value, and the temperature are transferred to the analog signal, there is a possibility that a signal disturbed due to noise around the product is transmitted, which may result in sensitivity errors and temperature correction errors. On the other hand, since the composite sensor 130 according to the present disclosure includes a conductivity sensor 137, an optical sensor 134, a temperature sensor 136, and an MCU part 132 and integrates them into one module, an analog signal is converted into a digital signal in one sensor, the temperature correction is immediately performed on the conductivity value and the transmittance value required for the detection of contamination level, and a temperature-corrected digital value is output. Accordingly, the composite sensor 130 transmits the composite sensor value, which is temperature-corrected digital data, to the washing machine controller, and thereby, compared to sending an analog signal from conventional sensors to the washing machine controller, sensitivity error and temperature correction error can be reduced, and the accuracy of the detection value can be increased.

Figure 6:
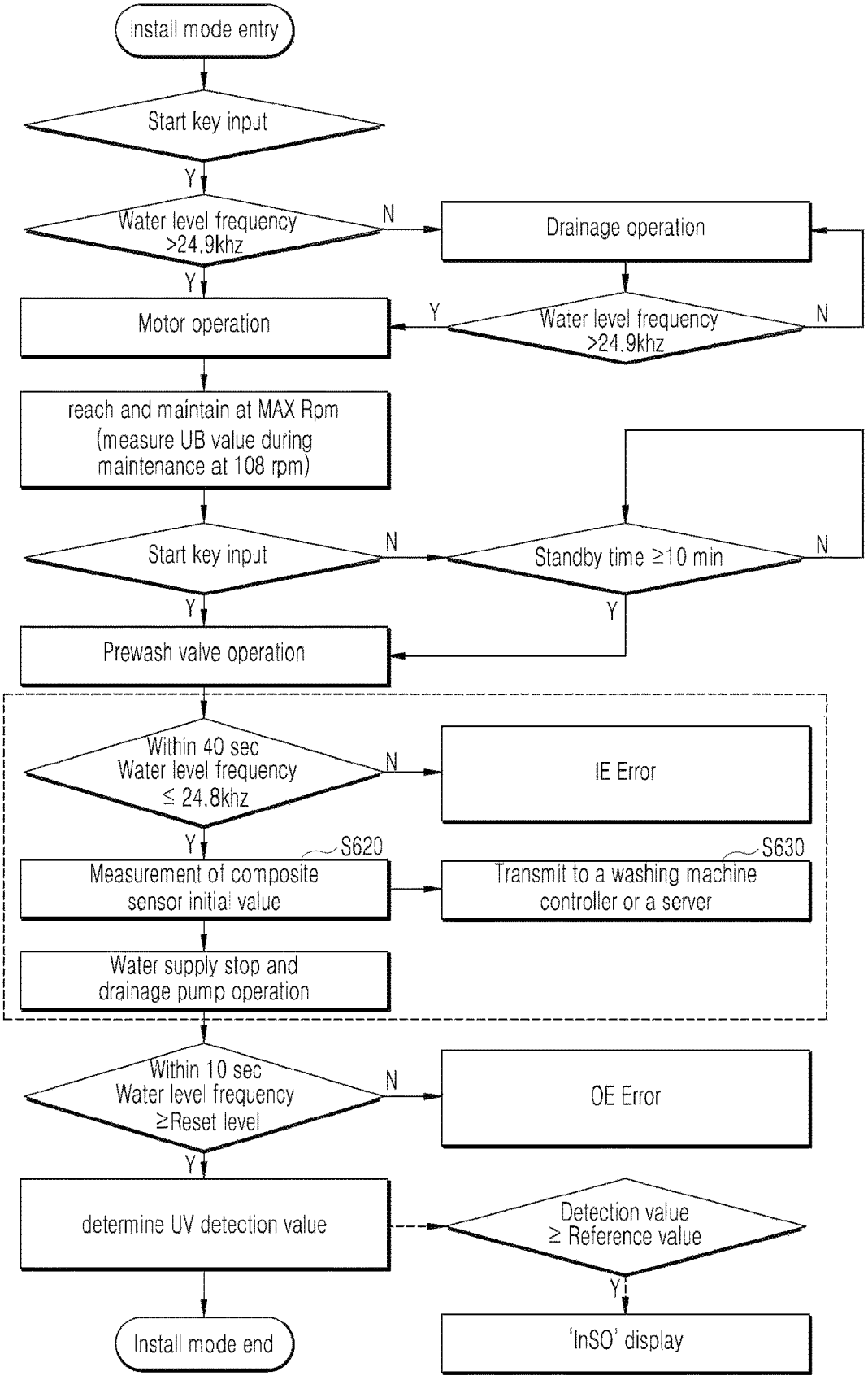
FIG. 6 is a flowchart of an install mode of a washing machine according to an embodiment of the present disclosure.

FIG. 6 is a flowchart of an install mode of a washing machine 100 according to an embodiment of the present disclosure. In one embodiment of the present disclosure, the washing machine 100 can extract an initial value of sensor data which is a standard for determining a level of contamination of a laundry tub. When a user purchases the washing machine 100, in order to confirm the operation of the washing machine and check the state of installation at the time of initial installation, an install mode is performed as shown in FIG. 6. Since detergent and laundry are not supplied when performing the install mode, the user environment water quality of non-contaminated wash water can be measured. Throughout the present disclosure, the water quality of the non-contaminated wash water measured without detergent input in the installed mode is referred to as an initial value of a composite sensor. The initial value of the composite sensor may include an initial conductivity value, an initial transmittance value, and an initial temperature value. In addition, the initial value of the composite sensor may be a temperature-corrected conductivity value and a transmittance value through a sensor MCU part 132. The composite sensor 130 extracts an initial value which is a standard for measuring the level of contamination in the install mode, and transmits the extracted value to the washing machine controller. Further, it may be transmitted from the composite sensor 130 or from the washing machine controller to a server 200 via wireless communication, for example, Wi-Fi.

The initial value of the composite sensor can be measured when the water level of the wash water reaches a certain level by water supply in the install mode. In one embodiment of measuring the initial value of the composite sensor, when the washing machine 100 starts water supply in the install mode of the washing machine 100, a motor is operated, and an eccentricity (UB value) is measured. When a prewash valve is operated and a water level rises to a certain level, the water supply error (IE error) and drainage error (OE error) are checked and determination of the eccentricity detection value, and the like are performed. The measurement of the initial value of the composite sensor is possible as long as water is supplied to the washing machine during the entire processes of the install mode, and in one embodiment, the measurement can be made between prewash valve operation and water supply stop and drainage pump operation.

Figure 7:
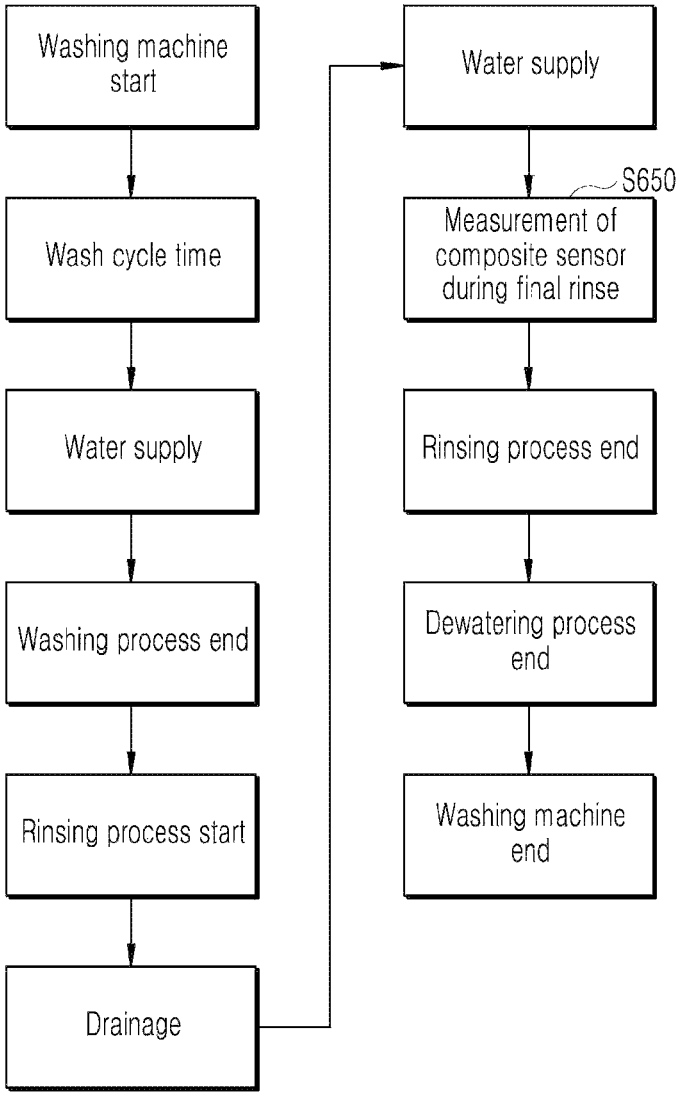
FIG. 7 is a washing flowchart including the time when the composite sensor detects a level of contamination of a laundry tub in the washing and rinsing steps of the washing machine according to an embodiment of the present disclosure.

FIG. 7 is a washing flowchart including the time when the composite sensor 130 detects a level of contamination of a laundry tub in the washing and rinsing processes of the washing machine 100 according to an embodiment of the present disclosure. Washing of the laundry starts supplying power to the washing machine 100, and the entire washing processes of washing, rinsing and dewatering are performed. Then, washing of the laundry is performed until power supply is stopped and the washing machine 100 is ended. In an embodiment of FIG. 7, a rinsing process is started and the composite sensor value can be measured during the final rinse process. Subsequently, a rinse process is ended and a dewatering process is ended.

Contamination of the laundry tub can be generated from detergents, laundry, and contaminants accumulated in a laundry tub. For the washing of the laundry, one or more processes of washing, rinsing and dewatering may be performed by a user or according to a predetermined course. When the washing machine 100 is used, contaminants remain and accumulate in the laundry tub after washing or dewatering, and the contaminants accumulated in the laundry tub in this manner affect a washing water during washing, rinsing and dewatering processes. Since most of the contamination of the laundry tub from the detergent and laundry is removed by a final rinse process, contamination of the laundry tub during the final rinse is considered to be most affected by the contaminants accumulated in the laundry tub. Therefore, it is preferable that measurement of the composite sensor value for detecting the level of contamination of the laundry tub is performed at the final rinse, which is the last rinsing of the entire washing processes. If the contamination level of the water drained can be measured even after the final rinsing, for example, before the washing machine 100 is ended in the dewatering process, the value measured by the composite sensor 130 herein can be treated in the same manner as the final rinse cycle value of the composite sensor.

Figure 8:
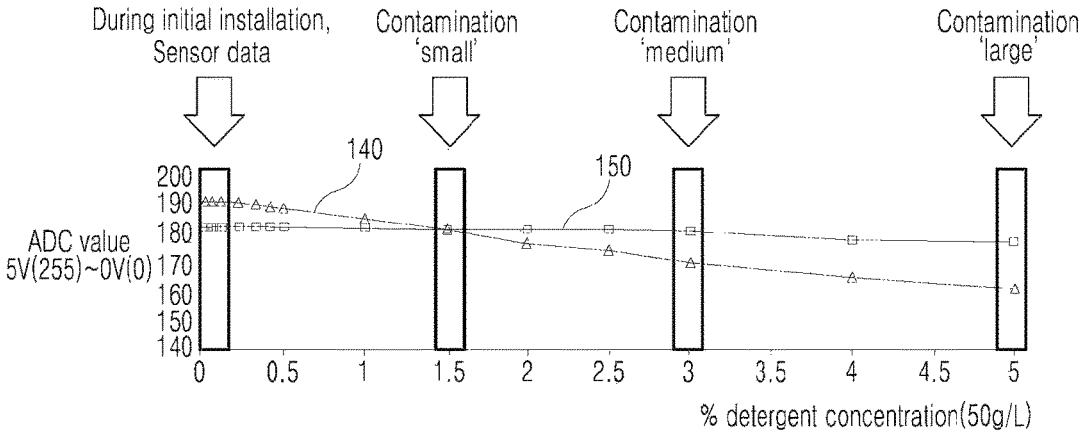
FIG. 8 is a graph showing composite sensor values according to the level of contamination of the laundry tub in the washing machine according to one embodiment of the present disclosure.

FIG. 8 is a graph showing composite sensor values according to the level of contamination of the laundry tub in the washing machine 100 according to one embodiment of the present disclosure. When the washing machine 100 is operated in the entire processes of washing, rinsing, and dewatering, the data of the final rinse cycle value of the composite sensor is extracted at a specific cycle and transmitted to the server, which can be compared with an initial value of the composite sensor to classify the contamination level into "large, medium, small" and no contamination (contamination level "large, medium, small, zero").

In the graph of FIG. 8, the vertical axis represents an ADC value (Analog Digital Conversion value), and as an example, it is expressed in a range of 5V (255) to 0V (0). The horizontal axis is a percent (%) detergent concentration value at 50 g/L. Triangular curve of the graph is a transmittance curve 140, and square curve is a conductivity curve 150. In one embodiment of FIG. 8, the range of the percentage detergent concentration boundaries of the contamination levels "large, medium, small, zero" may be classified into contamination level 'large' (5.0% or more), 'medium' (3.0%~less than 5.0%), 'small' (1.5%~less than 3.0%) and 'zero' (0%~less than 1.5%). The initial values of the composite sensor (transmittance value and conductivity value), which are zero contamination level (0%), are 190 and 182 ADC values, the boundary composite sensor values, which are small contamination level (1.5%), are 180 and 181 ADC values, the boundary composite sensor values, which are medium contamination level (3.0%), are 170 and 180 ADC values, and the boundary composite sensor values, which are large contamination level (5.0%), are 160 and 178 ADC values. In one embodiment of the present disclosure, generally, if the level of contamination of the laundry tub has a detergent concentration of 5.0% or more, which corresponds to a contamination level 'large', it may be defined as the point of time when the tub cleaning is notified.

Since the initial value of the composite sensor differs depending on the user's washing water supply environment, the initial value of the composite sensor which is a standard for determining the level of contamination of the laundry tub may be changed. In such a case, the standard of the contamination level 'large, medium, small, zero' can be relatively defined based on the initial value of the composite sensor. In one example, the size of the difference between the initial value of the composite sensor and the current value of the final rinse cycle composite sensor [(final rinse cycle conductivity value)-(initial conductivity value), and (final rinse cycle transmittance value)-(initial value of transmittance)] can be a standard for determining the contamination level "large, medium, small, zero". Further, in another embodiment, the graph of conductivity and transmittance from the composite sensor initial value to the current final rinsing may be integrated to determine the contamination level 'large, medium, small, zero' according to the size of the area of the graph.

In one embodiment of the present disclosure, the washing machine controller and/or the server transmits the composite sensor value to the washing machine controller or the server communicating with the washing machine 100 from the sensor MCU part 132 at regular intervals to collect final rinse cycle values of the composite sensor. The washing machine controller and/or the server generates a training data set and/or a test data set for applying a machine learning algorithm using the final rinse cycle value of the composite sensor received at regular intervals, and the result value (labeled value) of the contamination level determination for the composite sensor value. Typically, the test data set is determined by dividing a part of the training data set. The ratio of the training data set and the test data set may vary depending on the amount of data, and generally, it can be determined at a ratio of 7:3. Throughout the present disclosure, a "learned model" refers to learning a training data set and testing it through the test data set to determine a learned model even without any special mention. The washing machine controller and/or the server stores the training data set and/or the test data set in a storage unit, and allows the stored training data to learn through a machine learning algorithm in order to predict the progressing degree of contamination of the laundry tub according to the washing and rinsing processes. The learned model is tested through the test data set to determine a learned model. After the learned model is determined, it is possible to predict a change in contamination level through the learned model for the received final rinse cycle value of the composite sensor, and determine the remaining time until cleaning of the laundry tub or the number of times of washing.

The controller may include an artificial neural network, for example, a deep neural network (DNN) such as CNN, RNN, DBN, etc. and learn a deep neural network. As a machine learning method of the artificial neural network, both unsupervised learning and supervised learning can be used. After learning according to the setting, the controller can control so as to update an artificial neural network structure for detecting the contamination level of the laundry tub.

The controller and/or the server can determine the level of contamination of the laundry tub, and guide to a user at least one of the contamination level of the laundry tub, the cleaning time of the laundry tub, or the cleaning method of the laundry tub at regular intervals. The remaining time until cleaning of the tub can be displayed as a date on the assumption that washing is performed once a day. However, since the user can use the washing machine 100 several times a day, it is possible to display the number of remaining times until the tub cleaning time by the number of times of use. As the level of contamination is greater, it is closer to the cleaning time of the tub. Therefore, the remaining time until cleaning of a laundry tub and the number of times of cleaning as predicted under the contamination level will be larger than the remaining time until cleaning of the tub and the number of times of cleaning as predicted within the contamination level. The user can be guided of the remaining time until cleaning of the tub or the number of times of cleaning through a washing machine display or a personal terminal 300, and prepare a tub cleaning rinse in advance.

Figure 9:
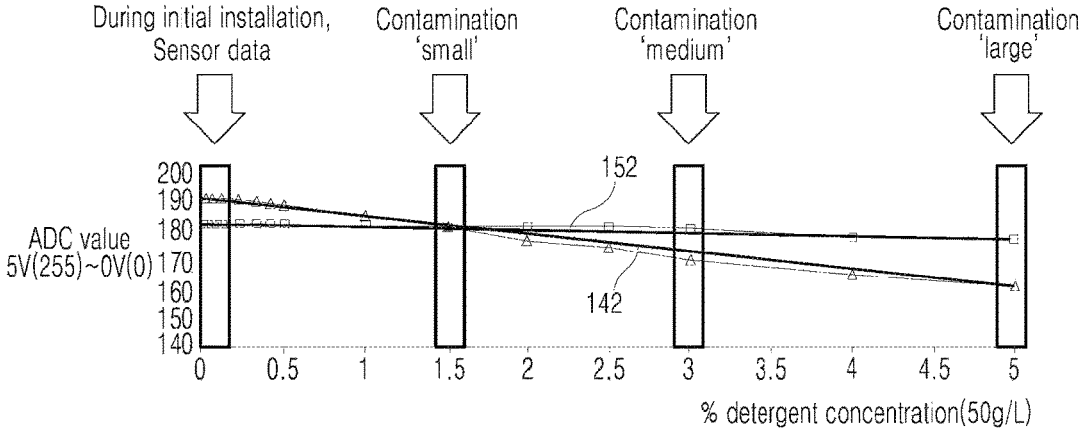
FIG. 9 is an exemplary view of a linear regression line obtained by machine learning from cumulative composite sensor values of a washing machine and a washing system in accordance with an embodiment of the present disclosure.

FIG. 9 is an exemplary view of a linear regression line obtained by machine learning from cumulative composite sensor values of a washing machine 100 and a washing system in accordance with an embodiment of the present disclosure. The machine learning algorithm can be applied to precisely analyze a level of contamination of the laundry tub. In one embodiment of the present disclosure, the machine learning algorithm uses a final rinse cycle value of the composite sensor and a result value of the contamination level for the final rinse cycle value of the composite sensor as a training data set and/or a test data set in order to predict the progressing degree of contamination, and thereby a regression analysis algorithm may be applied.

If it is allowed to learn (train) using a conductivity data and a transmittance data of the composite sensor, that is, a training data set, as shown in FIG. 8, a model is created that is a basis of the corresponding regression model. The regression model finds the same optimal model as that when the distribution of data can be represented in a single line. And assuming once that the model of the learned data is correct, finding and showing this line can be seen as performing learning. In FIG. 8, when the point of the training data is located, it can be hypothesized that the optimal linear model (line) is a straight line. When expressed with a mathematical equation, $H(x)=Wx+b$, wherein $H(x)$ refers to a hypothesis, and the shape of the line changes depending on the value of W (weight) and the numerical value of b (bias).

FIG. 9 illustrates a transmittance linear regression line 142 and a conductivity linear regression line 152 in which a linear model is obtained by using, as a training data set, ADC values of contamination level 'zero' (greater than 0%~less than 1.5%), contamination level 'small' (1.5%~less than 3.0%), contamination level 'medium' (3.0%~less than 5.0%) and contamination level 'large' (5.0% or more), starting from the composite sensor initial values (transmittance value and conductivity value), which are 0% detergent concentration of FIG. 8. Here, when the drawn line calculates the difference from the distribution of each data, the smallest can be seen to be suitable for this model. In other embodiment, the hypothesized regression line of the regression analysis may be multiple regression curves. In this case, when the verification error increases so that overfitting does not occur, learning can be stopped to determine a learned regression model.

Based on the change in the level of contamination predicted through the linear regression analysis of FIG. 9, it is possible to determine the remaining time until cleaning of the laundry tub and the number of times of cleaning. The remaining time until correct tub cleaning and the number of times of cleaning can be more precisely predicted using machine learning and deep learning algorithms as the learning data set accumulates.

Figure 10:
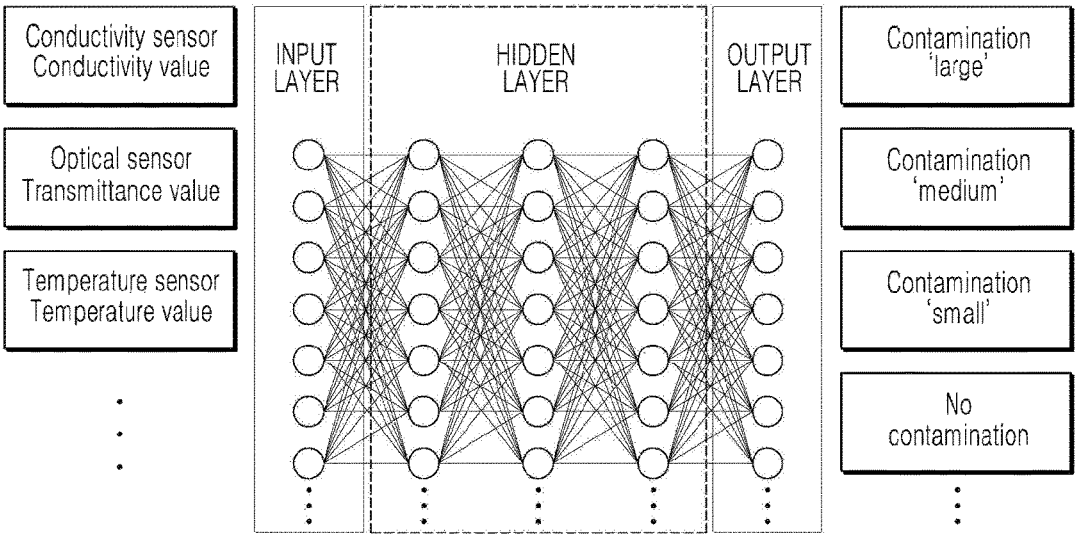
FIG. 10 is an exemplary view of a deep learning structure which is allowed to learn cumulative composite sensors values and labeled contamination level values at a washing machine and a washing system in accordance with an embodiment of the present disclosure.

FIG. 10 is an exemplary view of a deep learning structure which is allowed to learn cumulative composite sensors values and labeled contamination level values at a washing machine 100 and a washing system in accordance with an embodiment of the present disclosure. As the composite sensor initial value stored in the washing machine controller and/or the server and the number of times of using the washing machine are increased, the controller can apply a deep learning structural learning model in which the stored composite sensor value is an input layer and the contamination level "large, medium, small, zero" value is an output layer. That is, the machine learning algorithm can include a deep learning structure comprising an input layer that includes, an initial value of the composite sensor stored in the washing machine controller or the server, and a final rinse cycle value of the composite sensor that is stored as the number of times of using the washing machine increases, and an output layer that includes at least one of large, medium, small, or zero values of levels of contamination. As shown in FIG. 10, it is possible to constitute an artificial neural network structure for detecting contamination of laundry tub including three input layers of conductivity value, transmittance value, and temperature, three hidden layers, and output layers of contamination level 'large, medium, small, zero'.

The deep learning structure for detecting a level of contamination of the laundry tub can be learned up to a deep level in multiple stages based on the composite sensor output data. The deep learning structure can represent a set of machine learning algorithms that extract key data from a plurality of data as the stage increases.

The deep learning structure for detecting a level of contamination of the laundry tub can be composed of a deep neural network (DNN) such as CNN (Convolutional Neural Network), RNN (Recurrent Neural Network) and DBN (Deep Belief Network). The deep learning structure according to one embodiment of the present disclosure can use various known structures. For example, the deep learning structure according to the present disclosure may include CNN, RNN, DBN and so on. The RNN is often used for natural language processing, etc., and it is a structure which is effective for processing time-series data that changes along the flow of time, which can construct an artificial neural network structure by stacking layers every moment. The DBN can include a deep learning structure constructed by stacking RBM (restricted boltzman machine) as a deep running technique in multiple layers. If RBM learning is repeated to have a certain number of layers, it is possible to construct a DBN with a corresponding number of layers. The CNN may include a model that extracts basic features of an object when a person recognizes the object, and then performs complex calculations in the brain, and simulates a human brain function created based on the assumption of recognizing an object based on the result.

On the other hand, learning of the artificial neural network can be achieved by adjusting weight of connecting lines between nodes (also adjusting a bias value if necessary) so that a desired output is obtained for a given input.

Figure 11:
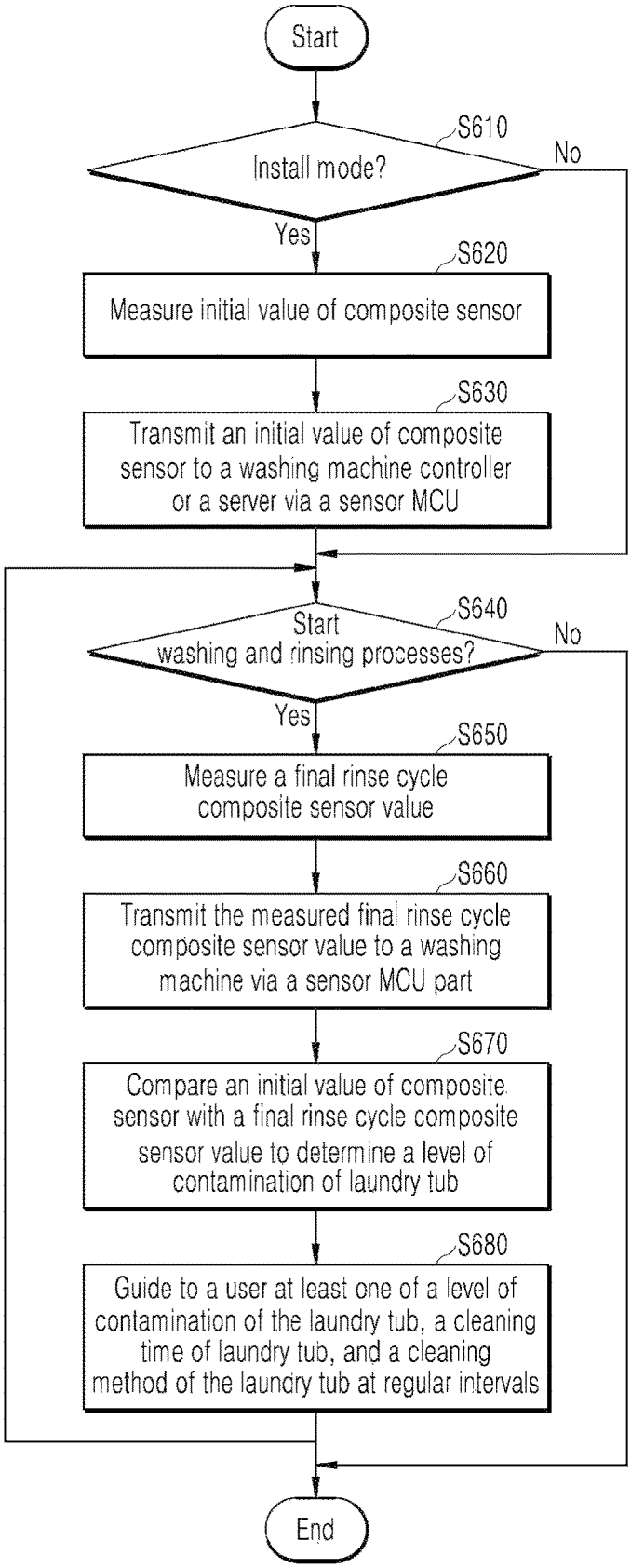
FIG. 11 is a flowchart of a method of detecting a level of contamination of a laundry tub for a washing machine according to an embodiment of the present disclosure.

FIG. 11 is a flowchart of a method of detecting a level of contamination of a laundry tub for a washing machine 100 according to an embodiment of the present disclosure. In the following description, a repeated description of portions identical to those described above with reference to FIGS. 1 to 10 will be omitted.

Referring to FIG. 11, in step S610, the washing machine 100 determines whether it is in the install mode. If it is not in the install mode, it is determined in step S640 whether washing and rinsing processes have started.

In step S620, if it is in an install mode, the initial value of the composite sensor, which is a standard for a level of contamination of a laundry tub, is measured when water supply, drainage, and dewatering cycles are performed without detergent and laundry at the time of installation of the washing machine.

In step S630, the measured initial value of the composite sensor may be transmitted to the washing machine controller through a sensor MCU part 132. In another embodiment, the measured initial value of the composite sensor may be transmitted to a server via a washing machine controller or via Wi-Fi.

In step S640, when the user turns on the washing machine 100 and operates the washing machine 100, the washing machine 100 determines whether the washing or rinsing processes have started. If the washing and rinsing processes have not started, the washing machine is ended without performing the steps of determining the level of contamination of the laundry tub.

In step S650, when a user performs washing or rinsing processes, the final rinse cycle value of the composite sensor is measured.

In step S660, the measured final rinse cycle value of the composite sensor is transmitted from the sensor MCU part 132 to the washing machine controller. The final rinse cycle value of the composite sensor can be transmitted to the server via wireless communication such as Wi-Fi. The step of transmitting the final rinse cycle value of the composite sensor from the sensor MCU part 132 to the washing machine controller may include transmitting the composite sensor value from the sensor MCU part 132 to the washing machine controller at regular intervals, and accumulate the final rinse cycle values of the composite sensor as the number of times of using the washing machine increases.

In step S670, a washing machine controller or a server that receives the initial value and the final rinse cycle value of the composite sensor from the washing machine controller compares the initial value of the composite sensor with the final rinse cycle value of the composite sensor to determine the level of contamination of the laundry tub. In the step of determining the level of contamination of the laundry tub, the initial value of the composite sensor is compared with the final rinse cycle value of the composite sensor, and during the final rinse, the contamination level can be determined as 'large, medium, small' and no contamination ('zero') according to the degree of difference between the final rinse cycle value of the composite sensor and the initial value.

In step S680, after the step of determining the level of contamination of the laundry tub, the washing machine controller or the server guides to a user at least one of the contamination level of the laundry tub, the cleaning time of the laundry tub, or the cleaning method of the laundry tub at regular intervals.

Figure 12:
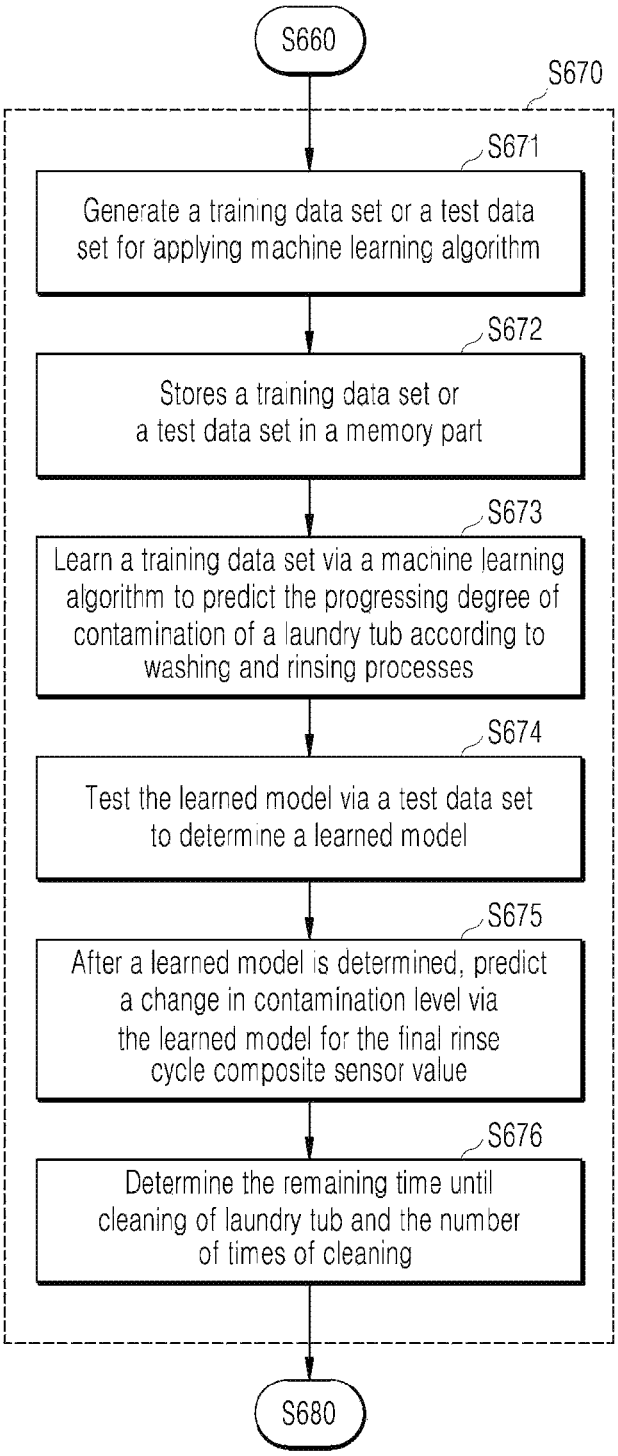
FIG. 12 is a flowchart of a method of detecting a level of contamination of a laundry tub for a washing machine or a washing system according to an embodiment of the present disclosure.

FIG. 12 is a flowchart of a method of detecting a level of contamination of a laundry tub for a washing machine 100 or a washing system according to an embodiment of the present disclosure. In the following description, a repeated description of portions identical to those described above with reference to FIGS. 1 to 11 will be omitted.

The step of determining the level of contamination of the laundry tub in step S670 may include a method of determining the level of contamination of the laundry tub through machine learning (steps S671 to S676).

The step of transmitting the final rinse cycle value of the composite sensor from the sensor MCU part 132 to the washing machine controller in step S660 may include transmitting the composite sensor value from the sensor MCU part 132 to the washing machine controller at regular intervals, and accumulate the final rinse cycle values of the composite sensor as the number of times of using the washing machine increases.

In step S671, the washing machine controller and the server generates a training data set and/or a test data set for applying a machine learning algorithm using the final rinse cycle value of the composite sensor received at regular intervals, and the result value (labeled value) of the contamination level determination for the composite sensor value. Since the test data set is obtained by separating a part of the training data set, only a training data set can be created, and a test data set can be selected later from a part of the training data set later. Further, since the quality of the data to be learned is important before applying a deep learning structure, it is possible to increase the performance of detecting the level of contamination of the laundry tub by data pre-processing before generating the training data set.

In step S672, the washing machine controller and/or the server stores the training data set and/or test data set in the storage unit.

In step S673, the washing machine controller and/or the server allows the stored training data set to learn through a machine learning algorithm in order to predict the progressing degree of contamination of the washing machine according to washing and rinsing processes. In another embodiment of the present disclosure, in order to more precisely determine the level of contamination of the laundry tub, the washing machine controller and/or the server allows a machine learning algorithm to learn a training data set, then proceed the washing and rinsing processes and re-learn the received additional training data set at the server, thereby generating a re-learned model.

In step S674, the learned model is tested through the test data set to determine a learned model. In another embodiment of the present disclosure, in order to more precisely determine the level of contamination of the laundry tub, the machine learning algorithm can proceed the washing and washing processes if the re-learned model has been generated at the washing machine controller or the server, predict changes in contamination level and determine the remaining time until cleaning of the laundry tub and the number of times of cleaning.

In step S675, after determining the learned model at the washing machine controller and/or the server, the change in contamination level is predicted through the learned model for the received final rinse cycle value of the composite sensor.

In step S676, the remaining time until cleaning of the laundry tub and the number of times of cleaning are determined based on the predicted change in contamination level.

Figure 13:
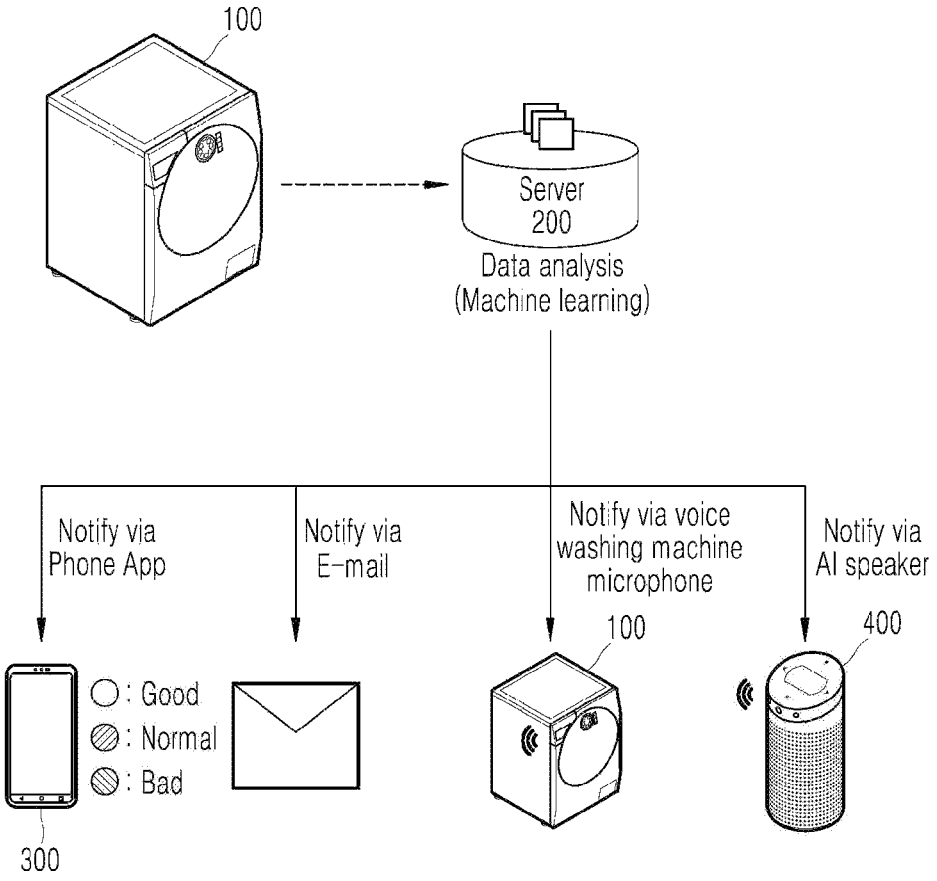
FIG. 13 is an exemplary view of a method of notifying a method of notifying the analysis result of a contamination level of the laundry tub in the washing system according to an embodiment of the present disclosure.

FIG. 13 is an exemplary view of a method of notifying a method of notifying the analysis result of a contamination level of the laundry tub in the washing system according to an embodiment of the present disclosure. The washing machine 100 may guide to a user at least one of the contamination level of the laundry tub, the cleaning time of the laundry tub (the remaining time until cleaning of the tub or the number of times of cleaning), or the cleaning method of the laundry tub at regular intervals on a washing machine display. As described above in FIG. 3, the driving environment 1 of the washing system may include a washing machine 100, a server 200, a user terminal 300, an output device 400, and a network 500. Therefore, the server 200 can also guide to the user at least one of the contamination level of the laundry tub, the cleaning time the laundry tub or the cleaning method of the laundry tub at regular intervals.

Embodiments according to the present disclosure as described above can be implemented in the form of a computer program that can be executed via various components on a computer, and such a computer program may be recorded on an a computer-readable medium. At this time, the medium may include a magnetic media such as a hard disk, a floppy disk, and a magnetic tape, an optical recording medium such as a CD-ROM and DVD, a magneto-optical medium such as a floptical disk, and a hardware device specifically configured to store and execute program instructions, such as a ROM, a RAM, a flash memory, and the like.

On the other hand, the computer program may be specially designed and configured for the present invention or known and available to those skilled in the field of computer software. Examples of the computer program include not only machine language codes created by a compiler or the like, but also high-level language codes that can be executed by a computer using an interpreter or the like The term "said" or other indicating terms similar thereto used in the detailed descriptions (in particular, the claims) may include both a singular form and a plural form. In addition, the description of a range may include individual values falling within the range (unless otherwise specified), and is the same as describing the individual values forming the range.

The steps constituting the method according to the present disclosure may be performed in appropriate order unless a specific order is described or otherwise specified. The inventive concept is not limited to the described order of the steps. All of the examples or exemplary terms (for example, etc.) are simply used to describe the technical idea in detail, and the range is not limited by the above-described examples or exemplary terms as long as they are not limited by the claims. In addition, a person skilled in the art can know that various modification, combinations, and changes are made according to a design condition or factor within the range of the attached claims or equivalents thereof.

Therefore, the scope of the present disclosure is defined not by the detailed description, but by the claims and their equivalents, and all variations within the scope of the claims and their equivalents are to be construed as being included in the present disclosure.

What is claimed is:

1. A washing machine for detecting a level of contamination of a laundry tub, the washing machine comprising:

a composite sensor that is configured to detect the level of contamination of the laundry tub, wherein the composite sensor integrates, into one module, (i) a conductivity sensor that is configured to detect conductivity to determine conductive contamination in the laundry tub, (ii) an optical sensor that is configured to detect a light transmittance to determine non-conductive contamination in the laundry tub, (iii) a temperature sensor that detects temperature in the laundry tub, and (iv) a sensor MCU part including a correction algorithm that is configured to correct a conductivity value and a transmittance value according to the detected temperature; and a washing machine controller that receives a digital signal from the composite sensor to determine the level of contamination of the laundry tub, wherein the composite sensor transmits, to the washing machine controller through the sensor MCU part, (i) an initial value of the composite sensor that is measured when performing water supply, draining, and dewatering processes without detergent and laundry at a time of installing the washing machine, and (ii) a final rinse cycle value of the composite sensor that is measured in a final rinse cycle when a user performs washing and rinsing processes, and wherein the washing machine controller stores the initial value of the composite sensor and the final rinse cycle value of the composite sensor in a storage part, and compares the initial value of the composite sensor and the final rinse cycle value of the composite sensor to determine a level of contamination of the laundry tub.

2. The washing machine of claim 1, wherein the sensor MCU part of the composite sensor is configured to:

convert an analog signal of the conductivity sensor and the optical sensor into a digital signal; and transmit, to the washing machine controller, a composite sensor value that includes temperature-corrected conductivity data and transmittance data determined using a correction algorithm.

3. The washing machine of claim 1, wherein the washing machine controller is configured to compare the initial value of the composite sensor with the final rinse cycle value of the composite sensor to determine the level of contamination during the final rinse cycle as one of large, medium, small, or non-contaminated (zero) classification result value, depending on a degree of difference between the final rinse cycle value and the initial value.

4. The washing machine of claim 3, wherein the washing machine controller is configured to:

receive a final rinse cycle value of the composite sensor;

generate a training data set using the received final rinse cycle value and the classification result value of the level of contamination corresponding to the final rinse cycle value;

learn, by applying the training data set to a machine learning algorithm, to predict a progressing degree of contamination of the laundry tub according to the washing and rinsing processes; and determine a learned model based on the learning.

5. The washing machine of claim 1, wherein the composite sensor is positioned in the washing machine at a location between an outer tub and an inner tub of the laundry tub that comes in contact with water during the washing and rinsing processes.

* * * * *